US009231287B2

(12) United States Patent
Burnes et al.

(10) Patent No.: US 9,231,287 B2
(45) Date of Patent: Jan. 5, 2016

(54) ISOTHERMAL TERMINATOR AND METHOD FOR DETERMINING SHAPE OF ISOTHERMAL TERMINATOR

(71) Applicant: Raytheon Company, Waltham, MA (US)

(72) Inventors: Clifford Burnes, Tucson, AZ (US); Ryan D. Dewitt, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 180 days.

(21) Appl. No.: 14/021,008

(22) Filed: Sep. 9, 2013

(65) Prior Publication Data

US 2015/0070109 A1 Mar. 12, 2015

(51) Int. Cl.
*H01P 1/26* (2006.01)

(52) U.S. Cl.
CPC . *H01P 1/264* (2013.01); *H01P 1/26* (2013.01)

(58) Field of Classification Search
CPC ..... H01P 1/264
USPC ..... 333/22 R, 248
See application file for complete search history.

(56) References Cited

U.S. PATENT DOCUMENTS

| | | | |
|---|---|---|---|
| 4,593,259 | A | 6/1986 | Fox |
| 4,968,150 | A | 11/1990 | Mathews |
| 5,565,822 | A | 10/1996 | Gassmann et al. |
| 7,002,429 | B2 | 2/2006 | Asao et al. |
| 7,488,210 | B1 | 2/2009 | Burris et al. |
| 7,734,271 | B2 | 6/2010 | Pepper et al. |
| 8,231,406 | B2 | 7/2012 | Burris et al. |
| 2005/0162235 | A1 | 7/2005 | An et al. |

FOREIGN PATENT DOCUMENTS

| | | | |
|---|---|---|---|
| DE | 1451616 | B1 | 8/1970 |
| JP | 61111001 | A | 5/1986 |
| JP | 08335808 | A | 12/1996 |

OTHER PUBLICATIONS

International Search Report issued in PCT/US2014/043795 on Oct. 7, 2014, 5 pages.

Written Opinion issued in PCT/US2014/043795 on Oct. 7, 2014, 5 pages.

*Primary Examiner* — Stephen E Jones
(74) *Attorney, Agent, or Firm* — Cantor Colburn LLP

(57) ABSTRACT

An isothermal terminator system is provided. The isothermal terminator includes a waveguide formed to define a propagation channel through which electro-magnetic (EM) radiation is directed and a terminator including a body having an exterior surface and an interior surface opposite the exterior surface. The terminator is disposed in the propagation channel such that the EM radiation is incident on the exterior surface to raise a temperature of the body. The body is substantially isothermal with the EM radiation incident on the exterior surface.

17 Claims, 4 Drawing Sheets

ISOTHERMAL TERMINATOR AND METHOD FOR DETERMINING SHAPE OF ISOTHERMAL TERMINATOR

BACKGROUND

The present invention relates to an isothermal terminator and to a method of determining a shape of an isothermal terminator.

In typical radio frequency (RF) terminator assemblies, a cone shaped terminator is disposed within a waveguide through which RF radiation propagates toward an absorptive exterior surface of the cone shaped terminator. An interior surface of the terminator is on an opposite side from the exterior surface and, with the RF radiation incident on the exterior surface such that the RF radiation is absorbed by the cone shaped terminator, infrared (IR) radiation is emitted from the interior surface. The IR radiation emitted from the interior surface is detectable as an IR scene by an IR scanner positioned downstream from the terminator.

The cone shaped terminator has its conical shape because the conical shape promotes RF absorption and minimizes reflections. However, the conical shape also leads to thermal gradients being generated within the material of the cone shaped terminators. This thermal gradient leads to problems with the RF terminator assemblies being used in certain applications.

SUMMARY

According to one embodiment of the present invention, an isothermal terminator system is provided. The isothermal terminator includes a waveguide formed to define a propagation channel through which electro-magnetic (EM) radiation is directed and a terminator including a body having an exterior surface and an interior surface opposite the exterior surface. The terminator is disposed in the propagation channel such that the EM radiation is incident on the exterior surface to raise a temperature of the body. The body is substantially isothermal with the EM radiation incident on the exterior surface.

According to another embodiment, an isothermal terminator for disposition in a propagation path of electro-magnetic (EM) radiation is provided and includes a body having an exterior surface and being configured to react isothermally to the EM radiation being incident on the exterior surface to thereby generate a substantially enhanced electric (E) field distribution.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

In accordance with aspects of the present invention, an isothermal terminator is provided along with a method of forming an isothermal terminator by first defining its shape. The isothermal terminator may be configured to generate a substantially enhanced electric (E) field distribution at least with respect to linear conical terminators and may, in some cases, be used in building a stimulated black body.

Figure 1:
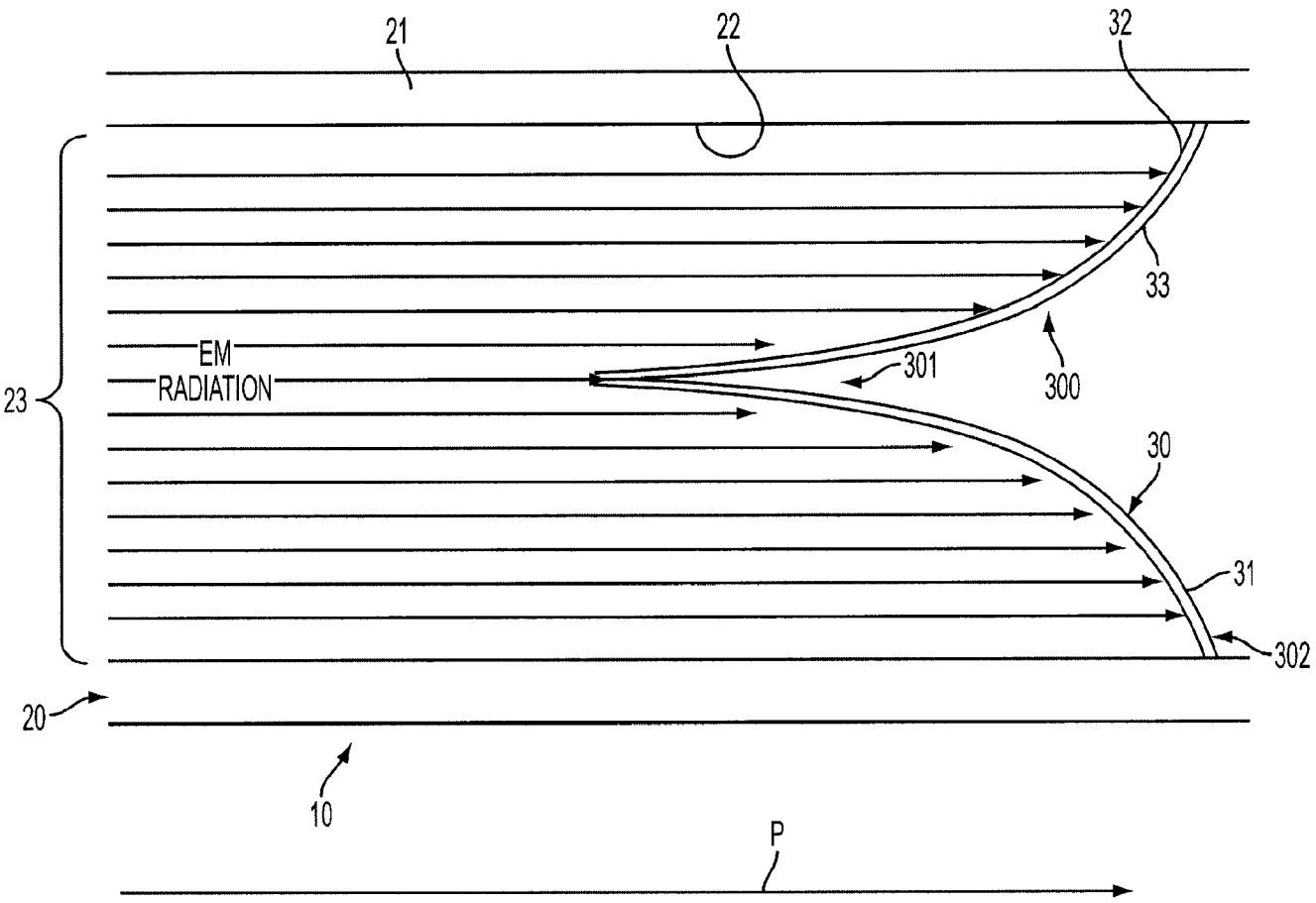
FIG. 1 is an isothermal terminator system including a waveguide and a terminator in accordance with embodiments.

With reference to FIG. 1, an isothermal terminator system 10 is provided and is similar in construction to the terminator described in greater detail in U.S. application Ser. No. 13/722,990, the entire contents of which are incorporated herein by reference. As shown in FIG. 1, the system 10 includes a waveguide 20 and a terminator 30. The waveguide 20 includes a generally annular or tubular member 21, which includes an inwardly facing surface 22 and which is formed to define a hollow propagation channel 23. An emitter (not shown) may be disposed at an end of the channel 23 to emit electro-magnetic (EM) radiation such that the EM radiation propagates through the channel 23 along the propagation direction P.

The terminator 30 includes a body 31 having an absorptive exterior surface 32 and an emissive interior surface 33. The interior surface 33 is on an opposite side of the body 31 from the exterior surface 32 and the terminator 30 is disposable in the propagation channel 23 such that the EM radiation is incident on the exterior surface 32 and is absorbed by the body 31. This absorption of the EM radiation leads to an increase in a temperature of the body 31 and causes the body 31 to emit infrared (IR) radiation from the interior surface 33. The IR radiation emitted from the interior surface 33 is detectable as an isothermal IR scene by an IR scanner (not shown) positioned downstream from the terminator 30 relative to the propagation direction P.

In order to facilitate the propagation of the EM radiation through the propagation channel 23, the tubular member 21 of the waveguide 20 may include highly specular (i.e., having a mirror-like finish). By a similar token, in order to facilitate the absorption of the EM radiation, the body 31 of the terminator 30 may include a substantially homogenous ceramic material, such as silicon carbide or another similar material. The body 31 may but is not required to have a substantially uniform thickness.

In addition, the EM radiation may be for example radio frequency (RF) radiation at a specified frequency. This specified frequency may be provided at a resonant frequency defined by the material of the body 31. In this way, an amount the body 31 can be heated by the EM radiation can be maximized.

In accordance with embodiments, the body 31 of the terminator 30 is formed to be substantially isothermal with the EM radiation being incident on the exterior surface 32. As such, the IR radiation that is emitted from the interior surface 33 is detected by the IR scanner in a manner that suggests that the body 31 is heated by the EM radiation substantially uniformly. That is, a color of the body 31 as displayed by the IR scanner will appear to be substantially uniform or at least will appear to have substantially less of a temperature gradient than that of a conical terminator.

The body 31 of the terminator 30 is isothermal or effectively isothermal due to its shape. In particular, body 31 of the terminator 30 is isothermal or effectively isothermal due to the fact that at least the exterior surface 32, the interior surface 33 or the body 31 as a whole is configured to have a concave cone shape 300. That is, the body 31 has an opening angle from the tip 301 to the back end 302 that increases by a second order parabolic or exponential function referenced to a center axis of the concave cone shape 300, as will be discussed in greater detail below.

Figure 2:
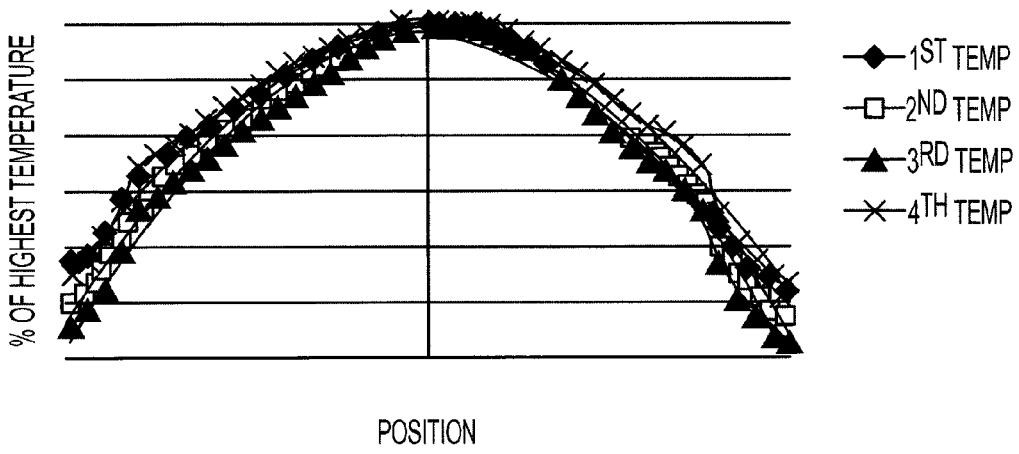
FIG. 2 is a graphical depiction of a thermal gradient of a conical terminator at various temperatures.
Figure 3:
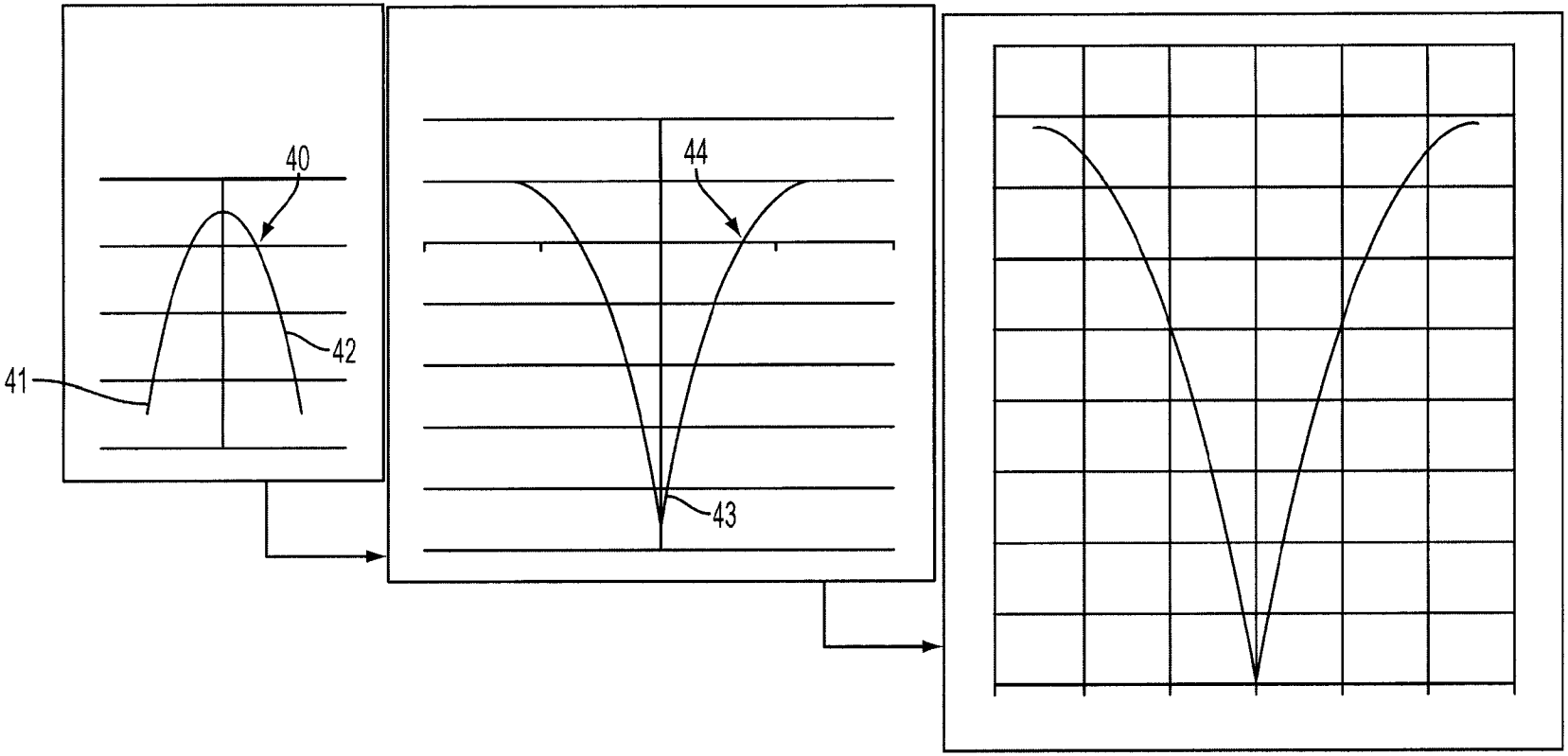
FIG. 3 is a diagram of a method of forming an isothermal terminator in accordance with embodiments.

With reference to FIGS. 2 and 3, a method of forming an isothermal terminator similar to the terminator 30 described above is provided. The method generally includes mapping a thermal gradient produced by viewing an open end of a constant thickness conical shaped terminator stimulated by, for example, radio frequency energy, where cone temperature is a function of radial position of the cone and the gradient decreases by a similar percentage of the maximum temperature regardless of maximum temperature (provided the minimum temperature of the cone is greater than ambient temperatures). By applying a best fit function to the thermal gradient curves recorded, that function can be inversed to define how the cone can be reshaped to provide more projected surface area to the RF stimulation side of the cone for higher E-Field EM (or, more particularly, RF) absorption.

In greater detail, the method includes initially installing a conical terminator into the waveguide 20 and allowing RF radiation to be incident upon its exterior surface. The resulting IR radiation emitted by the interior surface of the conical terminator is detected and converted into a graphical depiction of a thermal gradient for the conical terminator. This process is repeated several times for various levels of RF radiation so that thermal gradients for various temperatures of the conical terminator are generated. The data associated with these thermal gradients are then graphed as shown in FIG. 2.

As shown in FIG. 3, a best fit curve 40 may be derived from the graphed thermal gradients in accordance with known methods. The best fit curve 40 is generally shaped as an upwardly curved parabola having a derivative of zero at a substantially central point along which an axis may be defined. The method then includes offsetting each side 41, 42 of the best fit curve 40 in opposite directions as illustrated in the middle image of FIG. 3. This offsetting is continued until the formerly remote ends of each of the sides 41, 42 of the best fit curve 40 terminate at a common point 43 to form a conjunction of offset best fit curve halves 44. At this point, the conjunction of offset best fit curve halves 44 is normalized as shown in the right-side image of FIG. 3 to a height of the original conical terminator.

Figure 4:
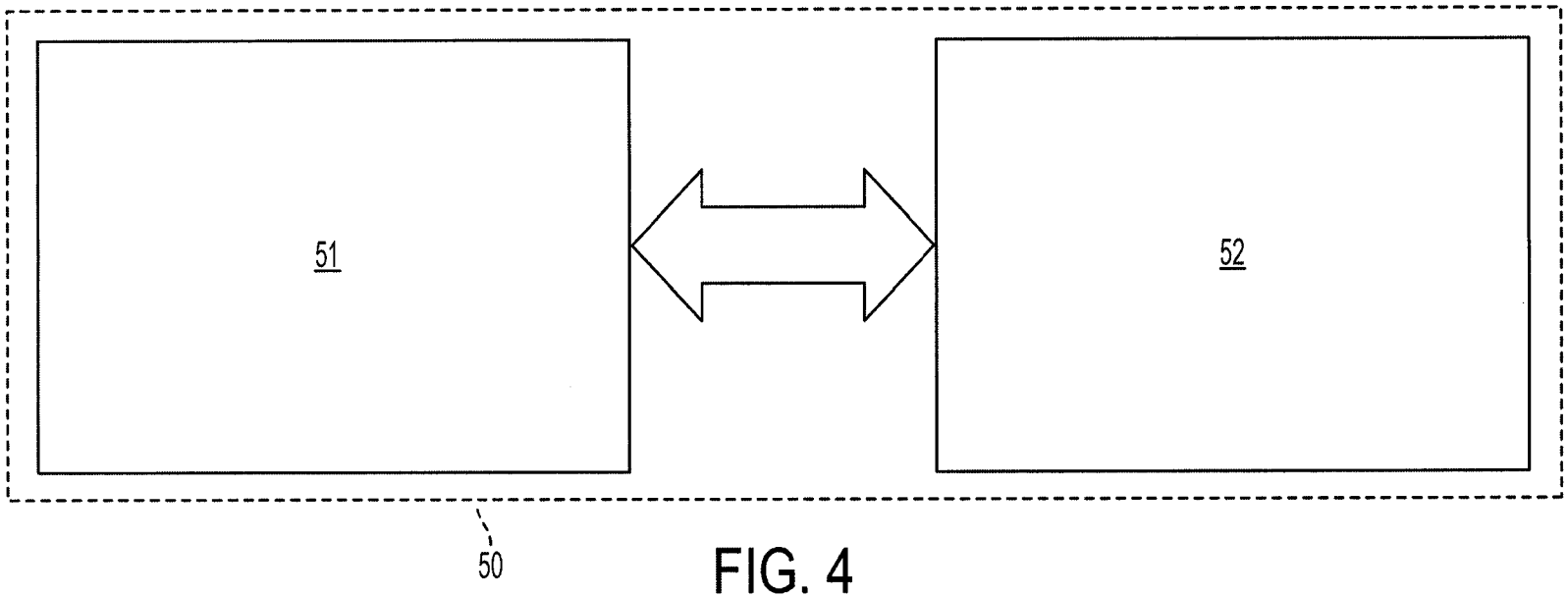
FIG. 4 is a schematic diagram of a computing system to execute the method of FIG. 3 in accordance with embodiments.

With reference to FIG. 4, the methods described above may be accomplished by a computing system 50 including a processing unit 51 and a non-transitory computer readable storage medium 52 to which the processing unit 51 is operably coupled. The computer storage medium 52 has executable instructions stored thereon, which, when executed, cause the processing unit 51 to perform the methods described above. For example, when executed, the executable instructions cause the processing unit 51 to derive the best fit curve 40, to offset each side 41, 42 of the best fit curve 40 in opposite directions as illustrated in the middle image of FIG. 3 and to continue the offsetting until the formerly remote ends of each of the sides 41, 42 of the best fit curve 40 terminate at the common point 43 to form the conjunction of offset best fit curve halves 44. The executable instructions may further cause the processing unit 51 to normalize the conjunction of offset best fit curve halves 44 as shown in the right-side image of FIG. 3 to the height of the original conical terminator.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

While embodiments to the invention have been described, it will be understood that those skilled in the art, both now and in the future, may make various improvements and enhancements which fall within the scope of the claims which follow. These claims should be construed to maintain the proper protection for the invention first described.

What is claimed is:

1. An isothermal terminator system, comprising:

a waveguide formed to define a single propagation channel through which electro-magnetic (EM) radiation is directed; and a terminator including a body having an exterior surface and an interior surface opposite the exterior surface, the terminator being disposed in the propagation channel such that the EM radiation is incident on the exterior surface to raise a temperature of the body;

the body being substantially isothermal with the EM radiation being incident on the exterior surface.

2. The isothermal terminator system according to claim 1, wherein the EM radiation comprises RF radiation at a resonant frequency defined by a material of the body.

3. The isothermal terminator system according to claim 1, wherein the body has a uniform thickness.

4. The isothermal terminator system according to claim 1, wherein the waveguide comprises a specular interior surface to which the body of the terminator is connected.

5. The isothermal terminator system according to claim 1, wherein the exterior surface absorbs EM radiation and the interior surface emits EM radiation.

6. The isothermal terminator system according to claim 1, wherein the interior surface has a concave cone shape.

7. The isothermal terminator system according to claim 6, wherein the body has a second order increasing opening angle with reference to a center axis of the concave cone shape.

8. The isothermal terminator system according to claim 1, wherein the exterior surface, the body and the interior surface of the terminator comprises a homogenous ceramic material.

9. The isothermal terminator system according to claim 8, wherein the homogeneous ceramic material comprises silicon carbide.

10. An isothermal terminator for disposition in a having a specular interior surface defining a propagation path of electro-magnetic (EM) radiation, the isothermal terminator comprising:

a body comprising:

an exterior surface, on which EM radiation propagating through the waveguide along the propagation path is primarily incident, the exterior surface being absorptive of the EM radiation; and an interior surface, which is emissive of infrared (IR) radiation, the body being connected to the specular interior surface of the waveguide and configured to react isothermally to the EM radiation being incident on the exterior surface to thereby generate a substantially enhanced electric (E) field distribution.

11. The isothermal terminator according to claim 10, wherein the EM radiation comprises RF radiation at a resonant frequency defined by a material of the body.

12. The isothermal terminator according to claim 10, wherein the exterior surface has a concave cone shape.

13. The isothermal terminator according to claim 10, wherein the body has a second order increasing opening angle.

14. The isothermal terminator according to claim 10, wherein the body has a substantially uniform thickness.

15. The isothermal terminator according to claim 10, wherein the body comprises a substantially homogenous ceramic material.

16. The isothermal terminator according to claim 15, wherein the substantially homogeneous ceramic material comprises silicon carbide.

17. An isothermal terminator system, comprising:

a waveguide comprising an inwardly facing surface defining a propagation channel through which electro-magnetic (EM) radiation is directed, the inwardly facing surface having a same width at an axial terminus thereof and at a recessed axial location thereof, which is axially recessed from the axial terminus; and a terminator including a body having an exterior surface and an interior surface having a concave cone shape opposite the exterior surface, the terminator being disposed in the propagation channel such that a curvature of the exterior surface continues toward an angular interface with the inwardly facing surface at the recessed axial location of the waveguide and with the axial terminus of the waveguide extending axially substantially beyond the interior surface, and such that the EM radiation is incident on the exterior surface to raise a temperature of the body;

the body being substantially isothermal with the EM radiation being incident on the exterior surface and having a second order increasing opening angle with reference to a center axis of the concave cone shape.

* * * * *